US007086226B2

(12) United States Patent
Oguri

(10) Patent No.: US 7,086,226 B2
(45) Date of Patent: Aug. 8, 2006

(54) CONSTRUCTION MACHINE

(75) Inventor: Hideo Oguri, Hirakata (JP)

(73) Assignee: Komatsu Ltd., Tokyo (JP)

( * ) Notice: Subject to any disclaimer, the term of this patent is extended or adjusted under 35 U.S.C. 154(b) by 128 days.

(21) Appl. No.: 10/631,006

(22) Filed: Jul. 31, 2003

(65) Prior Publication Data

US 2005/0036894 A1 Feb. 17, 2005

(30) Foreign Application Priority Data

Jul. 31, 2002 (JP) ..... 2002-223077

(51) Int. Cl.
*F16D 31/02* (2006.01)

(52) U.S. Cl. ..... 60/414; 60/436

(58) Field of Classification Search ..... 60/414, 60/419, 436
See application file for complete search history.

(56) References Cited

U.S. PATENT DOCUMENTS 6,349,543 B1 * 2/2002 Lisniansky ..... 60/414
6,460,332 B1 * 10/2002 Maruta et al. ..... 60/414
6,666,022 B1 * 12/2003 Yoshimatsu et al. ..... 60/413
6,708,787 B1 * 3/2004 Naruse et al. ..... 180/53.8
6,725,581 B1 * 4/2004 Naruse et al. ..... 60/414

FOREIGN PATENT DOCUMENTS

JP 2002-275945 9/2002

* cited by examiner

*Primary Examiner*—Edward K. Look
*Assistant Examiner*—Michael Leslie
(74) *Attorney, Agent, or Firm*—Westerman, Hattori, Daniels & Adrian, LLP.

(57) ABSTRACT

In order to provide a construction machine by which energy regeneration can be performed reliably and battery and electrical power generator can be miniaturized, a construction machine has an engine, a hydraulic pump driven by the engine, and an actuator driven by discharge oil from the hydraulic pump, and a regenerative motor which rotates by return oil from the actuator is connected to the rotation shaft of the hydraulic pump. The hydraulic pump is driven by the engine and the regenerative motor when drive torque necessary in the hydraulic pump is larger than output torque generated by operation of the regenerative motor. Meanwhile, the hydraulic pump is driven by the regenerative motor when the drive torque of the hydraulic pump is smaller than output torque of the regenerative motor, and an electrical power generator connected to the rotation shaft of the hydraulic pump is operated to generate electricity by excess torque which has not been energy-regenerated in the hydraulic pump so that this generated electrical power is charged in a battery.

5 Claims, 9 Drawing Sheets

CONSTRUCTION MACHINE

BACKGROUND OF THE INVENTION

1. Field of the Invention

The present invention relates to a construction machine such as a hydraulic shovel and the like.

2. Description of the Background Art

Regarding a conventional construction machine, its mainstream is a-hydraulically-operated system. For example, in a hydraulic shovel, driving of a farm working machinery, revolution of an upper revolving body, and traveling of a lower traveling body are performed by a hydraulic actuator (hydraulic cylinder, hydraulic motor). Operations are executed by controlling the pressure oil which is discharged from a hydraulic pump whose drive source is an engine and which is supplied to that hydraulic actuator.

Operations of the hydraulic shovel are not always operations which need 100% power with respect to the engine capacity but are operations which need for example only 90% or 80% power in many cases. That is, as shown in FIG. 8 which is an engine-torque characteristic view, set are operation modes such as a point $P_S$ of "regular load mode" in which a regular load operation is executed, a point $P_L$ of "light load mode" in which a light load operation is executed, and the like, with respect to a point $P_H$ of "heavy load mode" in which a heavy load operation of 100% power output is executed. An equal horsepower control (the discharge of the hydraulic pump is controlled according to PQ curves (iso-horsepower contours) so as to obtain a drive torque at a matching point) is performed so that the drive torques of the hydraulic pump at each points $P_H$, $P_S$, $P_L$ match the output torques of the engine, to make effective use of the engine output to improve fuel efficiency. Here, the drive torque of the hydraulic pump means the torque that the engine is required by the hydraulic pump in order to drive the hydraulic actuator.

In the hydraulic shovel, mounted is an engine having an output corresponding to a maximum required horsepower of when a vehicle operates, that is, an engine in which the rated output point $P_H$ of the engine torque curve corresponds to a point on a maximum required horsepower line L shown in FIG. 8. FIG. 9 shows a graph depicting changes of an absorption horsepower of the hydraulic pump in one cycle at the time of performing "digging and loading operation" in which dug earth and sand is rotated to be loaded on a truck body in the "regular load mode" in which matching occurs at 90% of the rated output of the engine. The load change of the hydraulic shovel is very large as compared to a passenger car and the like, and its engine has sufficient horsepower as shown in the graph, wherein the average load rate with respect to the maximum horsepower of the engine in one cycle is approximately 80%, and wherein the average load rate of the engine in the case where one day operation including traveling/moving, waiting for a truck vehicle, and the like, is measured is approximately 60%. Similarly, when operations in the "heavy load mode" are performed, the average load rate does not become 100% due to load changes. That is, in the hydraulic shovel in which an engine having an output corresponding to a maximum required horsepower is mounted, the output that the engine can output has not been employed effectively.

In order to solve such problem, conventionally, it has been proposed to employ a hybrid type construction machine provided with an engine, an electrical power generator driven by the engine, a battery to charge for electric power generated by the electrical power generator, and an electric motor driven by electrical power of the battery for example as shown in patent document 1. A hybrid type construction machine according to this patent document 1 will be explained below.

FIG. 10 shows a drive system block diagram of the hydraulic shovel that is the conventional hybrid type construction machine. In the drawing, the pressure oil which is discharged from a variable capacity type hydraulic pump 32 driven by an engine 31 is supplied to various actuators 44, 44 (for example, a boom cylinder 44*a*, an arm cylinder, a bucket cylinder, a travel motor, and the like) via a control valve 33. The speed of the engine 31 is controlled by a governor 31*a* which receives a governor command from a controller 35. A first electric motor 37 which is integral with a flywheel is attached to the engine 31, and the first electric motor 37 is connected to a battery 39 via a first inverter 38 and a controller 35. The first electric motor 37 has the function as an electrical generator also and is constructed in such a way that motor operation for assisting the hydraulic pump driving by the engine 31 and electrical power generation operation in which electrical power is generated using the engine 31 as a drive source can be operationally switched in response to the command from the controller 35. Operation signals from various operation levers 34, 34 and detection signals from various sensors 36, 36 (rotation sensor, pressure sensor, torque sensor, or the like) are input to the controller 35, and various kinds of control is performed based on these signals.

An upper revolving body 42 of the hydraulic shovel is rotatable by means of a second electric motor 40 via a speed reducer 43, and the second electric motor 40 is connected to the battery 39 via a second inverter 41 and the controller 35. The second electric motor 40 has the function as an electrical power generator also, similarly to the first electric motor 37 and is constructed in such a way that motor operation to drive the upper revolving body 42 and electrical power generation operation by inertial energy of the upper revolving body 42 of the time of restricting rotation can be operationally switched in response to the command from the controller 35.

A bypass conduit 46 having a hydraulic motor 47 is provided on a conduit 45 of the bottom side of the boom cylinder 44*a*, and the hydraulic motor 47 is driven when return oil from the boom cylinder 44*a* passes through the bypass conduit 46. An electrical power generator 48 is connected to the hydraulic motor 47 and to the battery 39 via an AC/DC converter 49.

[Patent Document 1] Japanese Patent Application Laid-Open No. 2002-275945

In the hydraulic shovel, when an operational load is small and the drive torque of the hydraulic pump 32 is smaller than a predetermined output torque of the engine 31, the first electric motor 37 generates electricity by excess part of the engine output so that the battery 39 charges this generated electricity. When the operational load is large and the drive torque of the hydraulic pump 32 is larger than the predetermined output torque of the engine, the first electric motor 37 is driven by the electric power_stored in the battery 39 to assist the engine 31 to drive the hydraulic pump 32. Further, the hydraulic shovel is constructed in such a way that the electrical energy obtained when the second electric motor 40 is driven utilizing the inertial energy of the upper revolving body 42 at the time of revolution braking as well as the electrical energy obtained when the electrical power generator 48 is driven utilizing potential energy by high pressure return oil from the boom cylinder 44*a* are stored in the battery 39.

In such hydraulic shovel, excess energy of the engine 31 collected via the first electric motor 37, the inertial energy of the upper revolving body 42 collected via the second electric motor 40, and the potential energy of the boom cylinder 44*a* collected via the electrical power generator 48 are all converted into electrical energy. However, in attempting to reliably collect all energy described above and charge into the battery 39, there are problems that the respective electric motors 37, 40 and the electrical power generator 48 become large-sized and that a large capacity electricity storage device such as the battery 39 and the like becomes necessary.

SUMMARY OF THE INVENTION

The present invention has been made in order to solve the drawbacks in the prior art, and it is an object of the present invention to provide a construction machine by which energy can be collected reliably and an electricity storage device and an electrical power generator can be miniaturized.

Thus, a construction machine of claim 1 having an engine 1, a hydraulic pump 2 driven by the engine 1, and an actuator 4 driven by discharge oil from the hydraulic pump 2, wherein the construction machine is constructed in such a way that a regenerative motor 8 which rotates by return oil from the actuator 4 is connected to a rotation shaft of the hydraulic pump 2, and the hydraulic pump 2 is driven by the engine 1 and the regenerative motor 8 when drive torque necessary in the hydraulic pump 2 is larger than output torque generated by operation of the regenerative motor 8, while the hydraulic pump 2 is driven by the regenerative motor 8 when the drive torque necessary in the hydraulic pump 2 is smaller than output torque generated by operation of the regenerative motor 8, and an electrical power generator 11 connected to the rotation shaft of the regenerative motor 8 is operated to generate electricity by excess torque which has not been energy-regenerated in the hydraulic pump 2 so that this generated electrical power is stored in an electricity storage device 12.

The construction machine of claim 2 is constructed in such a way that the electrical power generator 11 is functioned as an electric motor to perform motor operation so as to assist driving of the hydraulic pump 2.

Further, the construction machine of claim 3 is constructed in such a way that respective rotation shaft of the electrical power generator 11 and rotation shaft of the regenerative motor 8 are provided separately from the rotation shaft of the hydraulic pump 2, and the respective electrical power generator 11, hydraulic pump 2, and regenerative motor 8 can be operated together via interlock means.

In the construction machine of claims 4, clutches 17, 18 for transmitting/disconnecting shaft torques to/from the rotation shaft of the hydraulic pump 2 are provided on at least either one of the rotation shaft of the electrical power generator 11 or the rotation shaft of the regenerative motor 8.

In the construction machine of claim 5, a continuously variable transmission 24 for changing the rotational speed of the electrical power generator 11 with respect to the rotational speed of the regenerative motor 8 is disposed between the electrical power generator and the regenerative motor.

With the construction machine of claim 1, return oil from the actuator 4 is collected in the regenerative motor 8, and this output torque is instantly energy-regenerated in the hydraulic pump 2. When the drive torque necessary in the hydraulic pump 2 is larger than the output torque of the regenerative motor 8, its deficit torque part only is generated in the engine 1 so that the hydraulic pump 2 is driven by the engine 1 and the regenerative motor 8. Thus, since an average necessary horsepower of the engine 1 decreases, the engine 1 can be miniaturized. When the drive torque necessary in the hydraulic pump 2 is smaller than the output torque of the regenerative motor 8, the hydraulic pump 2 is driven by the regenerative motor 8, and excess torque part which has not been energy-regenerated in the hydraulic pump 2 is stored in the battery 12 via the electrical power generator 11. Therefore, since only excess torque part which has not been instantly energy-regenerated in the hydraulic pump 2 is stored in the electricity storage device 12, the electricity storage device 12 and the electrical power generator 11 can be miniaturized, and energy regeneration can be performed reliably.

Since the construction machine of claim 2 is constructed in such a way that the electrical power generator 11 is functioned as an electric motor to assist driving of the hydraulic pump 2, the energy stored in the electricity storage device 12 is energy-regenerated efficiently for driving of the hydraulic pump 2, and thus energy can be saved.

With the construction machine of claim 3, since respective rotation shaft of the electrical power generator 11 and rotation shaft of the regenerative motor 8 are provided separately from the rotation shaft of the hydraulic pump 2, the present apparatus can be made compact.

With the construction machine of claim 4, energy regeneration operation of claims 1 to 3 can be performed smoothly and reliably.

With the construction machine of claim 5, the rotational speed of the electrical power generator 11 can be controlled to be the rotational speed by which a high electrical power generation efficiency can be obtained by the continuously variable transmission 24, and thus energy regeneration can be performed efficiently.

DETAILED DESCRIPTION OF THE PREFERRED EMBODIMENTS

Next, specific embodiments of a construction machine of the present invention will be described in detail with reference to the drawings.

Figure 1:
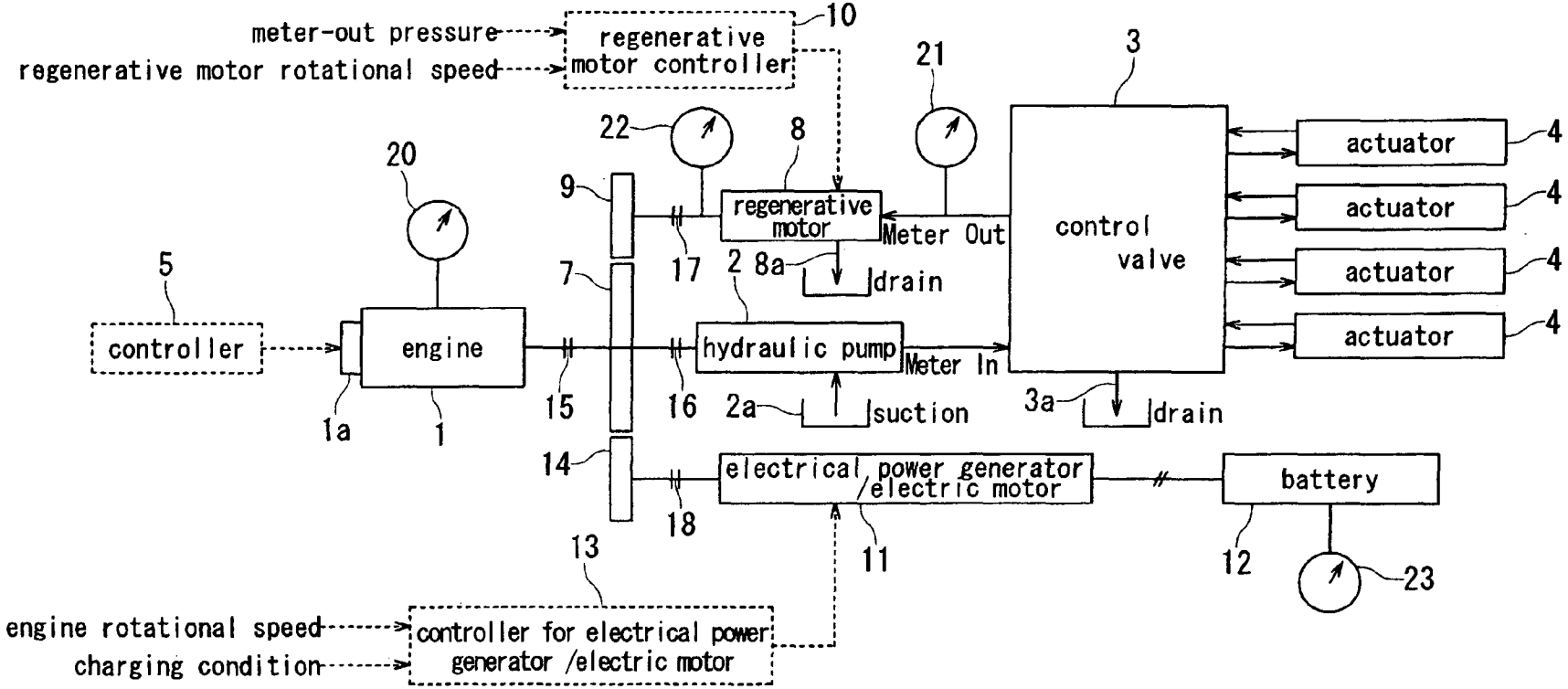
FIG. 1 is a schematic block diagram for explaining a drive system of a construction machine in one embodiment of the present invention.

FIG. 1 is a schematic block diagram for explaining a drive system of a construction machine in one embodiment of the present invention. In FIG. 1, the reference numeral 1 denotes an engine, and the rotational speed of this engine 1 is regulated by a governor 1*a* receiving a governor command from a controller 5. A rotation sensor 20 for detecting the engine rotational speed is provided on the engine 1. Furthermore, the reference numeral 2 denotes a variable capacity type hydraulic pump which is driven by the engine 1, and pressure oil (mater-in) which is discharged from the hydraulic pump 2 is supplied to various actuators 4, 4, for example, a boom cylinder, an arm cylinder, a bucket cylinder, a right side travel motor, a left side travel motor, a swing motor, and the like via a control valve 3. At this time, the angle of inclination of a swash plate of the hydraulic pump 2 is driven by an unillustrated swash plate angle drive means which is driven in accordance with a load on the respective actuators 4, 4 and a command from the controller 5 to control the discharge amount of the pressure oil from the hydraulic pump 2. An output gear 7 (interlock means) is provided between the engine 1 and the hydraulic pump 2, and a first clutch 15 and a second clutch 16 which are cutting means for cutting power transmission from the engine 1 to the hydraulic pump 2 are disposed on a rotation shaft sandwiching the output gear 7, that is, an output shaft of the engine 1 and an input shaft of the hydraulic pump 2, respectively. In addition, the output gear 7 also functions as a flywheel for driving the hydraulic pump 2 by inertial force when the first clutch 15 is cut so that the power from the engine 1 is shut off.

Meanwhile, the power of the return oil (meter-out) flowing back via the control valve 3 from the respective actuators 4, 4 is collected by a regenerative motor 8, and a regenerating gear 9 (interlock means) is coupled to the output shaft of the regenerative motor 8 via a third clutch 17. By engaging the regenerating gear 9 with the output gear 7, the regenerative motor 8 and the hydraulic pump 2 can be operated together. Thus, the power from the regenerative motor 8 is transmitted to the hydraulic pump 2 via the regenerating gear 9 and the output gear 7. Here, a pressure sensor 21 for detecting the meter-out pressure from the control valve 3 is provided on the input shaft of the regenerative motor 8, and a rotation sensor 22 for detecting the rotational speed of the regenerative motor 8 is provided on the output shaft of the regenerative motor 8. Detection signals from the pressure sensor 21 and the rotation sensor 22 are input to a controller 10 for the regenerative motor, and drive control of the regenerative motor 8 is performed in accordance with the command from the controller 10 for the regenerative motor. In addition, a drain 3*a* from the control valve 3 and a drain 8*a* from the regenerative motor 8 are returned to the inside of an oil tank 2*a* and are supplied to the hydraulic pump 2 again.

The reference numeral 11 in FIG. 1 denotes an electrical power generator; and a battery 12 for charging (accumulating) generated electric power which is generated by electrical power generation operation by the electrical power generator 11 is connected to the electrical generator 11. Furthermore, a gear 14 (interlock means) is coupled to the input shaft of the electrical power generator 11 via a fourth clutch 18, and by engaging this gear 14 with the output gear 7 of the engine 1, the electrical power generator 11 and the hydraulic pump 2 can be operated together. Meanwhile, the electrical power generator 11 also has the function as an electric motor to perform motor operation while utilizing electrical power stored in the battery 12 and is constructed in such a way that motor operation (functioning as an electric motor) to assist the driving of the hydraulic pump 2 and electrical power generation operation (functioning as an electrical power generator) in which electrical power is generated using the engine 1 and the regenerative motor 8 as drive sources can be switched in response to the command from an controller for electrical power generator/electric motor 13. Here, to the controller for electrical power generator/electric motor 13, input respectively are a detection signal from a charging sensor 23 provided in the battery 12 for detecting a charging condition and a detection signal from the rotation sensor 20 for detecting the engine rotational speed. In addition, for the battery 12, a secondary battery such as a lithium battery and the like is employed. Since this type of battery becomes an unstable state due to an increment of the internal pressure, decomposition of the electrolytic solution, or the like in a high temperature, always there is a need to monitor the voltage, current, temperature, and the like of the battery 12 to strictly control the temperature and charge/discharge thereof.

Figure 2:
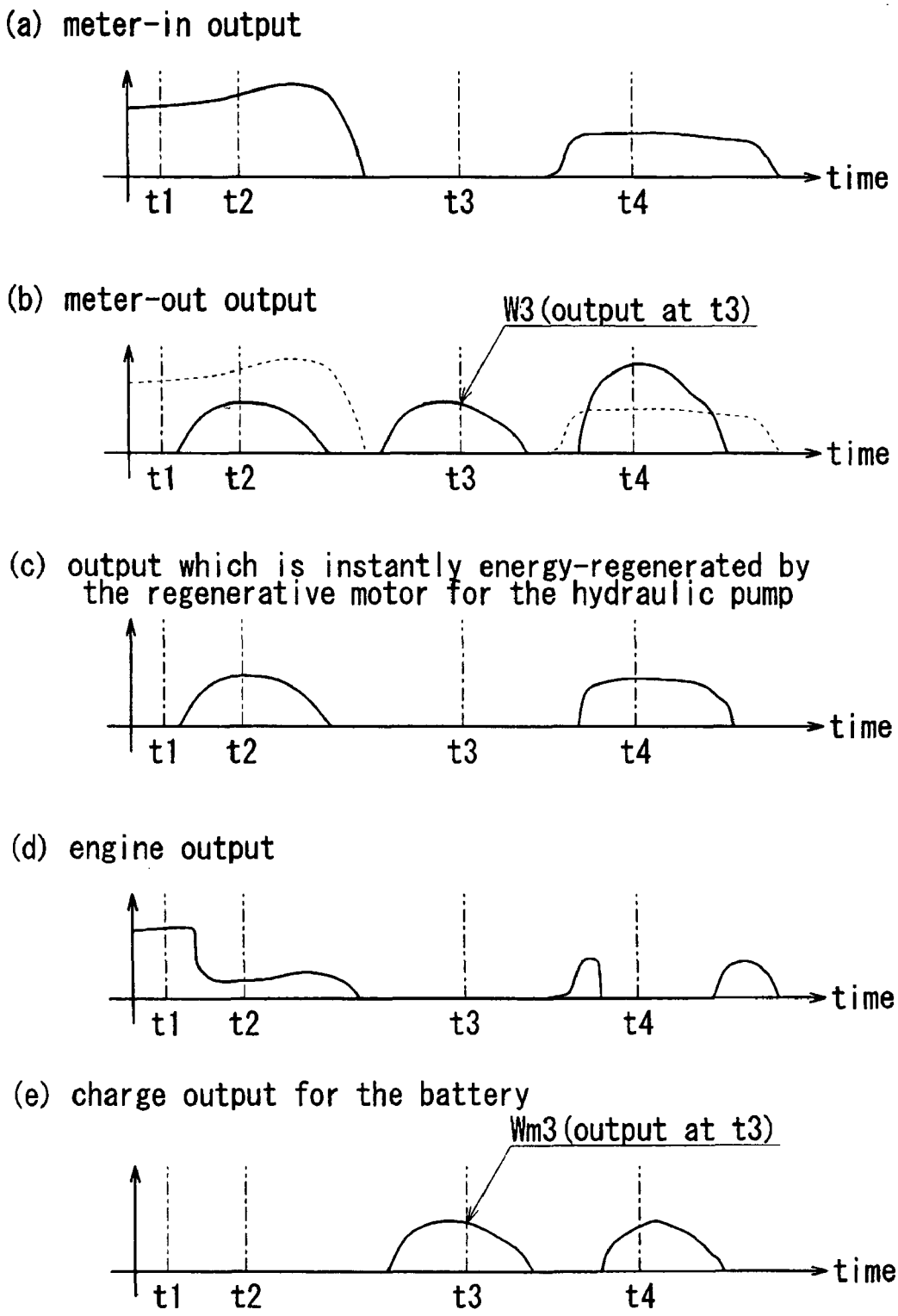
FIG. 2 is graphs showing one example of time changes of each output of when the drive system of the construction machine in the present embodiment is operated.

Next, a control method of the drive system of the construction machine in the present embodiment will be explained. In the present embodiment, drive torque necessary in the hydraulic pump 2, that is, a meter-in output supplied from the hydraulic pump 2 to the control valve 3 and output torque generated by the operation of the regenerative motor 8, that is, a meter-out output collected in the regenerative motor 8 from the control valve 3 are compared, and by this amount relationship, switching control of the drive system circuit shown in FIG. 1 is performed. In order to explain more in detail regarding this point, FIGS. 2(A) to 2(E) illustrate graphs showing one example of time changes of each output of when the drive system is operated. Here, FIG. 2(A) shows time change of the meter-in output, and FIG. 2(B) shows time change of the meter-out output (solid waveform lines), wherein dotted waveform lines show time change of the meter-in output. Meanwhile, FIG. 2(C) shows time change of the output in the meter-out output which is instantly energy-regenerated by the regenerative motor 8 for the drive of hydraulic pump 2. FIG. 2(D) shows time change of the engine output supplied to the hydraulic pump 2, and furthermore, FIG. 2(E) shows time change of the output stored in the battery 12 through the electrical power generator 11. Here, each output waveform shown in FIG. 2 shows an output example obtained when the electrical power generator/electric motor 11 functions as an electrical power generator. A specific control method of the drive system of the construction machine will be explained below based on FIG. 1 and FIG. 2.

More specifically, in FIG. 1, when an operator operates an unillustrated key switch, a start signal is input to the controller 5, and the controller 5 transmits a governor command of a rated rotational speed to the governor 1*a* to start the engine 1. At the same time, the first clutch 15 and the second clutch 16 are connected while the third clutch 17 and the fourth clutch 18 are disconnected so that the hydraulic pump 2 is driven only by the engine 1. The outputs obtained at this time are shown at time t1 in FIG. 2. Such control to drive the hydraulic pump 2 only by the output torque of the engine 1 is performed not only at the time of initial operation but also in the case where the meter-out output shown in FIG. 2(B) is zero while the meter-in output shown in FIG. 2(A) exists, that is, in the case where the output torque generated by the operation of the regenerative motor 8 is zero while the drive torque necessary in the hydraulic pump 2 exists.

Then, pressure oil discharged from the hydraulic pump 2 is supplied to various actuators 4, 4 via the control valve 3, and various operations are performed employing these actuators 4, 4. Meanwhile, the return oil flowing back from the respective actuators 4, 4 via the control valve 3 is collected in the regenerative motor 8 to be used for the operation of this motor. Here, in the case where the drive torque of the hydraulic pump 2 is larger than the output torque of the regenerative motor 8, that is, in the case where the meter-in output shown in FIG. 2(A) is larger than the meter-out output shown in FIG. 2(B), all return oil collected in the regenerative motor 8 is instantly energy-regenerated in the hydraulic pump 2 so as to drive the hydraulic pump 2 by both the output torque of the regenerative motor 8 and the output torque of the engine 1. The outputs obtained at this time are shown at time t2 in FIG. 2. Meanwhile, as specific circuit switching control of when the hydraulic pump 2 is driven employing both the engine 1 and the regenerative motor 8, the fourth clutch 18 is disconnected while the first clutch 15, the second clutch 16, and the third clutch 17 are connected to transmit the power of the regenerative motor 8 to the regenerating gear 9, and the rotation of the output gear 7 engaging the regenerating gear 9 is assisted by the rotation of the regenerating gear 9. In more detail, when the drive torque of the hydraulic pump 2 is larger than the output torque of the regenerative motor 8, even if all the meter-out output is energy-regenerated by the regenerative motor 8, since it does not reach the drive torque necessary in the hydraulic pump 2, the torque of this shortage is compensated by the output torque of the engine 1. Accordingly, at this time the engine output supplied to the hydraulic pump 2 corresponds to the output obtained by deducting the output energy-regenerated by the regenerative motor 8 from the meter-in output.

Meanwhile, when the drive torque of the hydraulic pump 2 is smaller than the output torque of the regenerative motor 8, that is, when the meter-in output shown in FIG. 2(A) is smaller than the meter-out output shown in FIG. 2(B), the hydraulic pump 2 is driven only by the motor operation of the regenerative motor 8, and excess torque part which has not been instantly energy-regenerated is stored in the battery 12 for driving the hydraulic pump 2. This corresponds to the output at time t4 in FIG. 2. As specific switching control, the first clutch 15 is disconnected to allow the engine 1 to idle while the second clutch 16, the third clutch 17, and the fourth clutch 18 are connected to transmit the power of the regenerative motor 8 from the generating gear 9 to the output gear 7 and to the gear 14 so as to operate the hydraulic pump 2 and the electrical power generator 11 so that only excess torque part which has not been energy-regenerated in the hydraulic pump 2 is converted into electrical energy to charge the battery 12. Therefore, at this time the output stored in the battery 12 corresponds to the output obtained by deducting the output which is instantly energy-regenerated in the hydraulic pump 2 from the meter-out output.

Meanwhile, as shown at time t3 in FIG. 2, when the meter-in output is zero while the meter-out output exists, that is, when the drive torque of the hydraulic pump 2 is zero while the output torque of the regenerative motor 8 exists, the meter-out output from the control valve 3 is all stored in the battery 12. As specific switching control, while the first clutch 15 and the second clutch 16 are disconnected to stop transmission of power to the hydraulic pump 2, the third clutch 17 and the fourth clutch 18 are connected so that the output torque generated by the operation of the regenerative motor 8 is transmitted from the generating gear 9 to the electrical power generator 11 via the output gear 7 and the gear 14 to operate the electrical power generator 11, whereby the output torque is converted into electrical energy to be stored in the battery 12.

Figure 3:
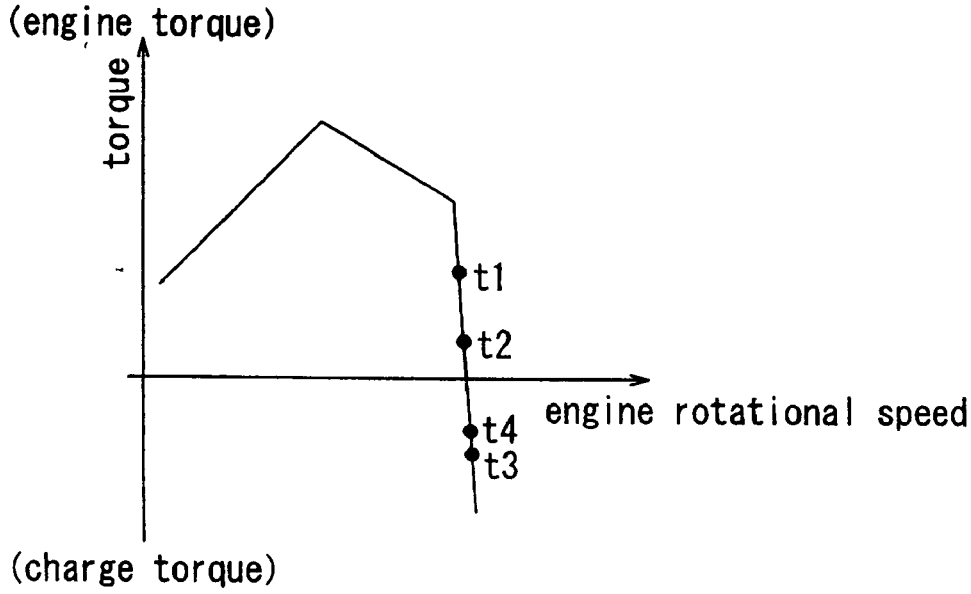
FIG. 3 is an engine torque characteristic graph in the present embodiment.

FIG. 3 shows an engine torque characteristic graph in the present embodiment. Here, t1 to t4 in this drawing show torque values of the engine output shown in FIG. 2(D) which are obtained at respective time t1 to t4. As shown in FIG. 2 and FIG. 3, since the hydraulic pump 2 is driven by the engine 1 at time t1 and t2, the engine torque becomes positive values. However, the engine output is zero at time t3 and t4, and conversely the battery 12 charges, and thus the engine torque is shown by negative values.

As described above, in the above-described embodiment, the return oil from the actuator 4 is collected by the regenerative motor 8, and the output torque thereof is instantly energy-regenerated in the hydraulic pump 2. When the drive torque necessary in the hydraulic pump 2 is larger than the output torque of the regenerative motor 8, its deficit torque part only is generated in the engine 1 so that the hydraulic pump 2 is driven by the engine 1 and the regenerative motor 8. Thus, since an average necessary horsepower of the engine 1 decreases, the engine 1 can be miniaturized. When the drive torque of the hydraulic pump 2 is smaller than the output torque of the regenerative motor 8, the hydraulic pump 2 is driven only by the regenerative motor 8, and excess torque part which has not been energy-regenerated in the hydraulic pump 2 is stored in the battery 12 via the electrical power generator 11. Therefore, since only excess torque part which has not been instantly energy-regenerated in the hydraulic pump 2 is stored in the battery 12, the battery 12 and the electrical power generator 11 can be miniaturized, and energy regeneration can be performed reliably. Further, in the present embodiment, the rotation shaft of the electrical power generator 11 and the rotation shaft of the regenerative motor 8 in the drive system circuit are respectively provided separately from the rotation shaft of the hydraulic pump 2, the present apparatus can be made compact.

Although the various control methods of the drive system of when the electrical power generator/electric motor 11 shown in FIG. 1 functions as an electrical power generator are described above, control methods of the drive system of when the electrical power generator/electric motor 11 functions as an electric motor which performs motor operation utilizing electrical power stored in the battery 12 will be described below. First, switching of the electrical power generator and the electric motor is performed in response to the command from the controller for electrical power generator/electric motor 13. Specifically, when charge amount of the battery 12 detected by the charging sensor 23 reaches a predetermined charging condition, a switching command from the controller for electrical power generator/electric motor 13 to the electric motor 11 is outputted. When switching to the electric motor is performed, the controller 5 newly connects the fourth clutch 18 in addition to connecting of the first clutch 15, the second clutch 16, and the third clutch 17 so that driving of the hydraulic pump 2 is assisted by the electric motor 11. That is, the electric motor 11 is allowed to perform motor operation by electrical power from the battery 12 to rotate the gear 14, and the rotation of the gear 14 is transmitted to the output gear 7 engaging therewith to assist the driving of the hydraulic pump 2 by the output torque of the engine 1 and the regenerative motor 8.

Although the hydraulic pump 2 is driven employing all of the engine 1, the regenerative motor 8, and the electric motor 11 in the above, it is possible to separate the engine 1 to drive the hydraulic pump 2 by the output torque of the regenerative motor 8 and the electric motor 11, and also it is possible to drive the hydraulic pump 2 only by the output torque of the electric motor 11.

As described above, in the above-described embodiment, in the case where the charge amount of the battery 12 reaches a predetermined charging condition, since driving of the hydraulic pump 2 is assisted utilizing this electrical power, energy can be saved.

Figure 4:
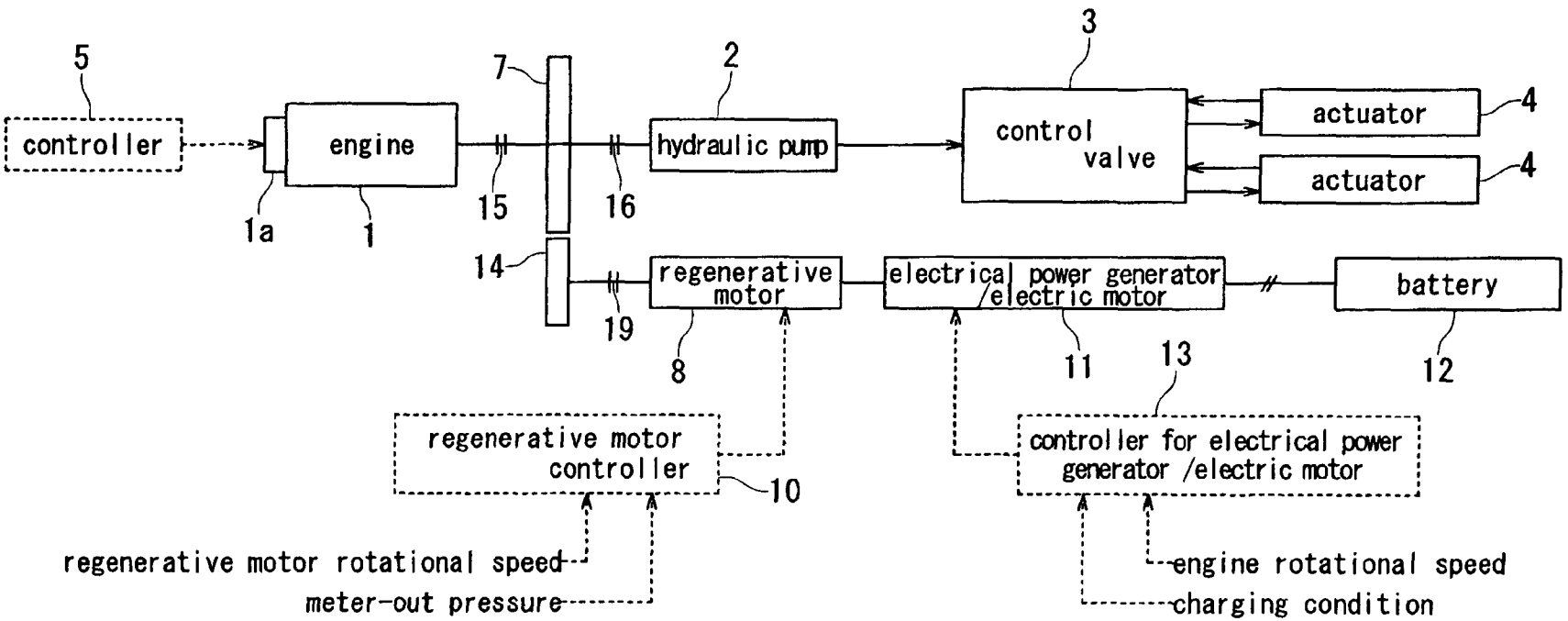
FIG. 4 is a schematic block diagram for explaining a modified example of a drive system of a construction machine according to the present invention.

Although a specific embodiment of a construction machine of the present invention has been explained, the present invention is not limited to the above-described embodiment and can be variously changed to be implemented within the present invention. For example, in the above-described embodiment, although the rotation shafts of the regenerative motor 8 and the electric motor 11 are provided separately from the rotation shaft of the hydraulic pump 2, the electric motor 11 can be provided on the same shaft as the rotation shaft of the hydraulic pump 2. Alternatively, as a modified example as shown in FIG. 4, the electrical power generator/electric motor 11 can be provided on the same shaft as that of the regenerative motor 8. Since other constructions are similar to those shown in FIG. 1, like functional portions are designated by like reference numerals, and explanation thereof will be omitted. In this case, a clutch 19 is disconnected to eliminate rotational loss of the regenerative motor under an operational condition that energy of the return oil is small. When the operational condition changes wherein the energy of the return oil becomes large, energy regeneration can be performed efficiently by accelerating the regenerative motor 8 by the electrical power generator/electric motor 11 to quickly set to a rotational speed appropriate for regenerating the energy of the return oil and then by connecting the clutch 19. Further, although the hydraulic pump 2 is driven utilizing the electrical power stored in the battery 12 in the above, the electrical power of the battery 12 may be employed to operate other control systems, other equipment (air conditioner, radio, and the like). Furthermore, in the above-described embodiment, although the battery 12 charges as one example of an electricity storage device, other than this, a capacitor can be employed to store electricity (charge). Moreover, in the above-described embodiment, although a plurality of controllers, such as the controller 5, the regenerating controller 10, and the controller for electrical power generator/electric motor 13, perform control, these controllers can be put together into one controller so as to perform all control. In the above-described embodiment, although shown is one example in which the first clutch 15 to the fourth clutch 18 are employed as a preferred example for transmitting and disconnecting shaft torques of the respective rotation shafts, the number and positions of clutches employed can be properly changed according to circumstances.

Figure 5:
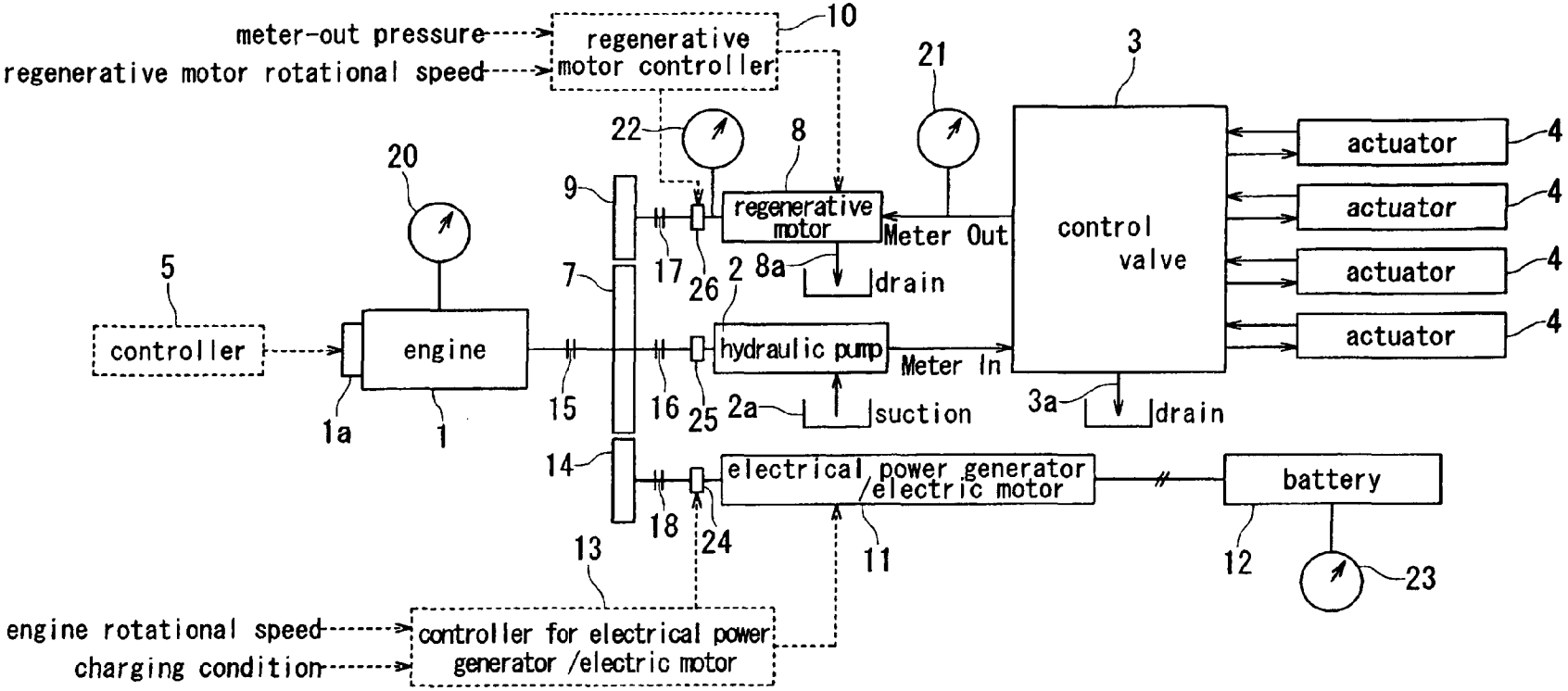
FIG. 5 is a schematic block diagram for explaining a drive system of a construction machine in another embodiment of the present invention.
Figure 6:
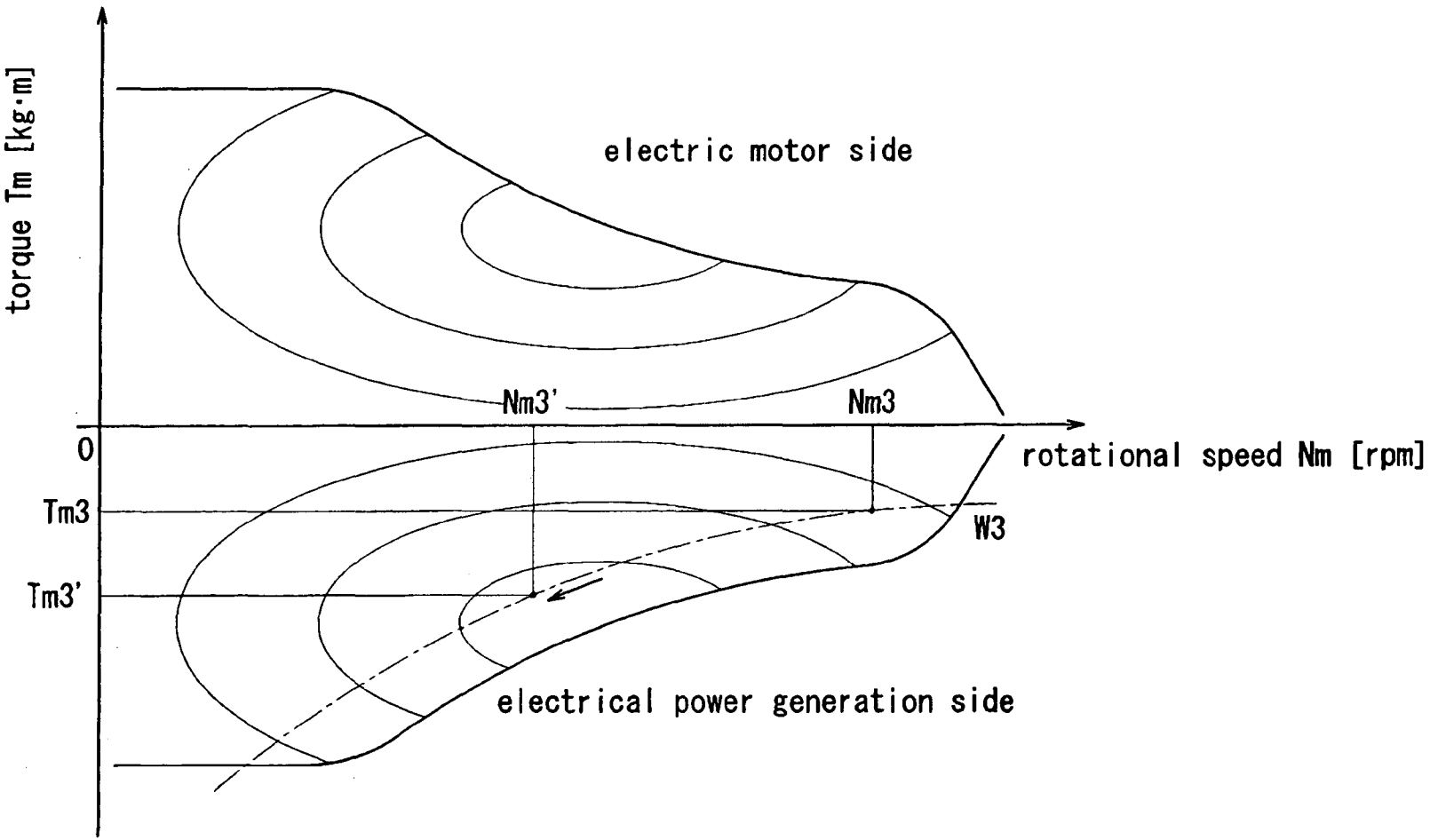
FIG. 6 is a graph for explaining the efficiency of the electrical power generator/electric motor.
Figure 7:
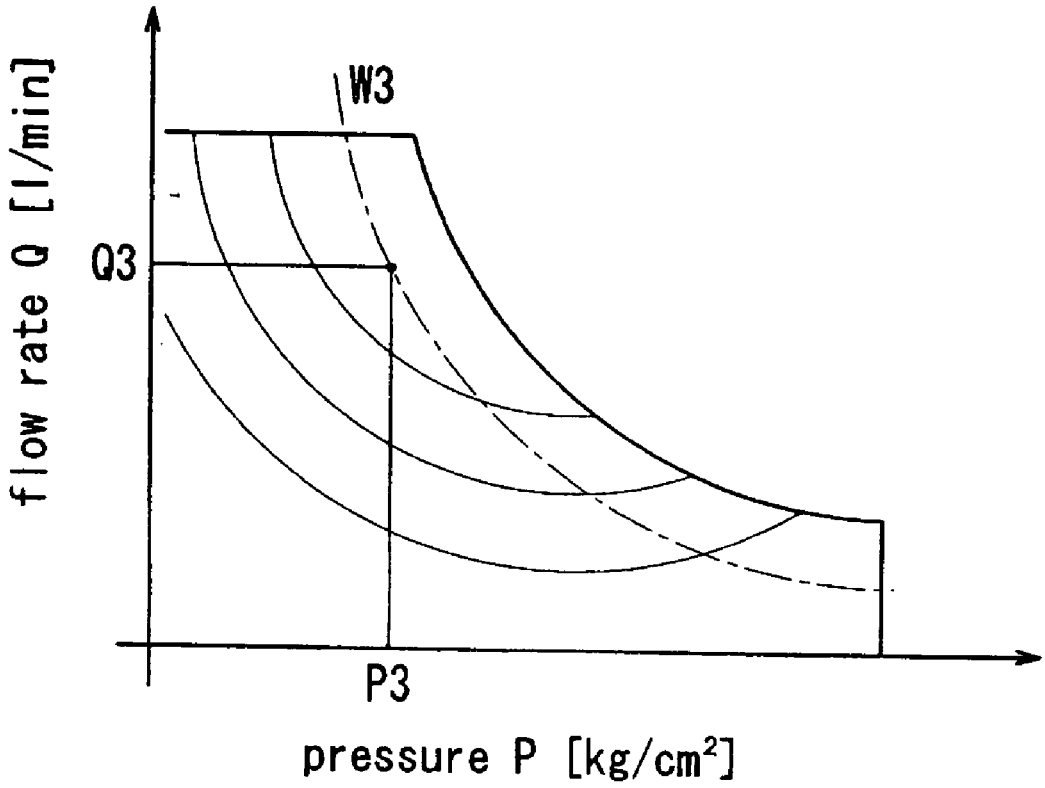
FIG. 7 is a graph for explaining the efficiency of the regenerative motor.
Figure 8:
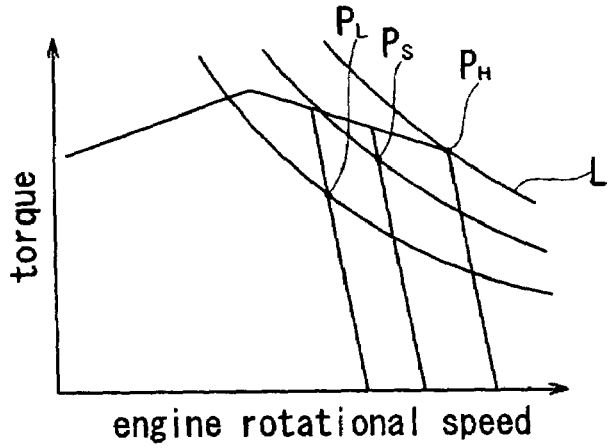
FIG. 8 is an engine torque characteristic graph for explaining operational conditions of a conventional construction machine.
Figure 9:
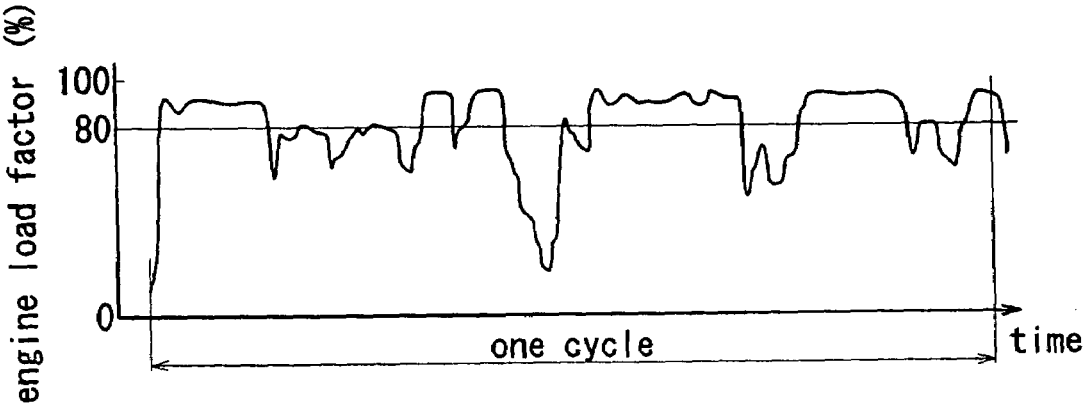
FIG. 9 is a graph showing changes of an absorption horsepower of a hydraulic pump in operation.
Figure 10:
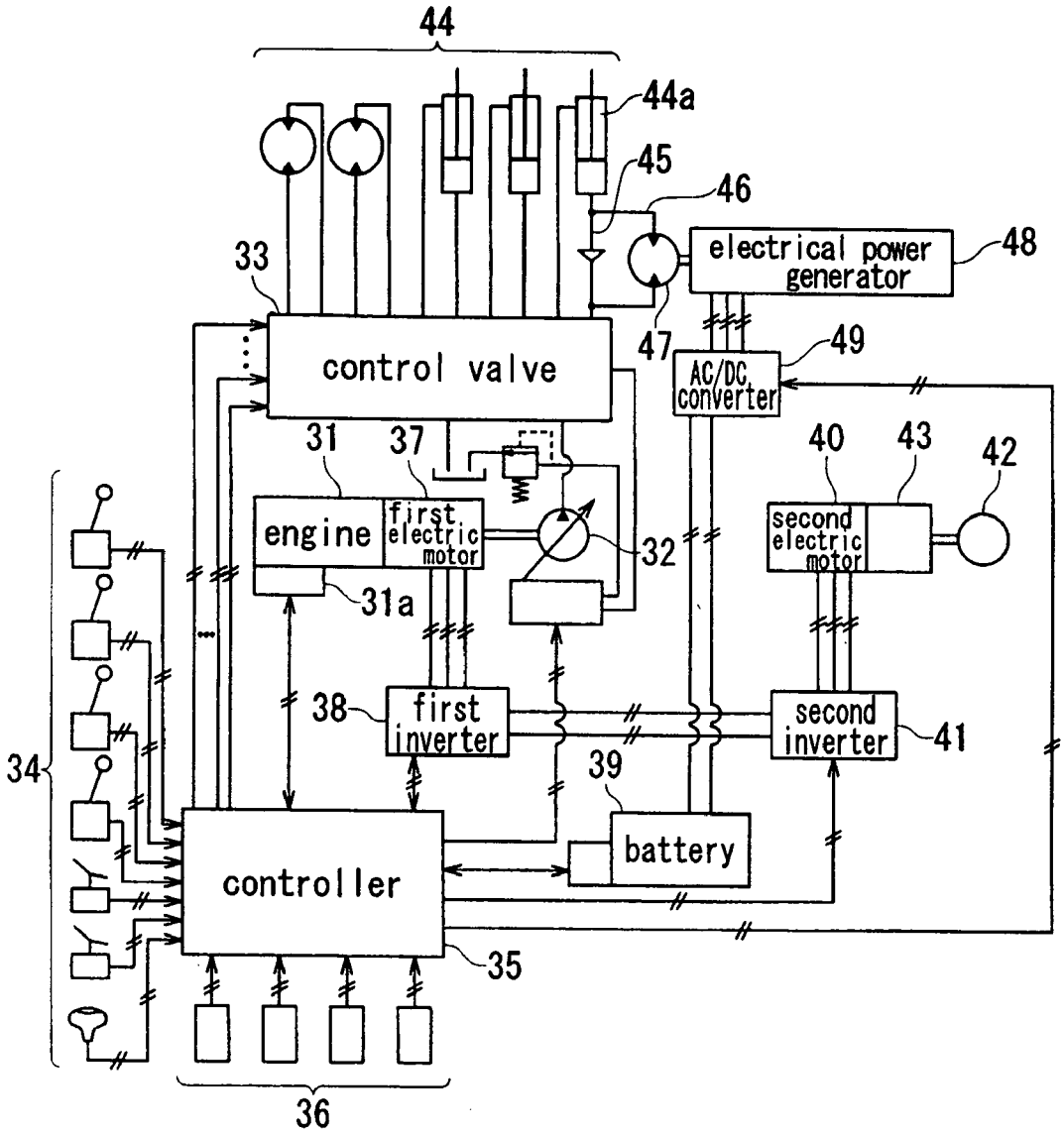
FIG. 10 is a drive system block diagram of a hydraulic shovel in a conventional hybrid type construction machine.

FIG. 5 shows another embodiment. In the present embodiment's structure, continuously variable transmission (hereinafter, referred to as CVT) 24, 25, 26 are disposed on the rotation shaft of the electrical power generator/electric motor 11, the rotation shaft of the hydraulic pump 2, and the rotation shaft of the regenerative motor 8, respectively. Since other parts of the structure are similar to those shown in FIG. 1, like reference numerals are employed to designate like functional elements, and explanation thereof will be omitted. The present embodiment is to control rotational speed ratios of the respective shafts so that efficiency of the entire system is improved by incorporating the CVT (continuously variable transmission) since respective engine 5, electrical power generator/electric motor 11, hydraulic pump 2, and regenerative motor 8 have efficient areas according to operational conditions. If one example is given concretely, for example, in the circumstance of t3 in FIG. 2, the regenerative motor 8 receives a meter-out output W3 to transmit it to the electrical power generator/electric motor 11, and the electrical power generator 11 outputs a charge output Wm3 for a battery. Here, for the sake of simplicity of explanation, torque transmission loss is ignored. FIG. 6 shows a rotational speed-torque characteristic of the electrical power generator/electric motor 11 together with iso-efficiency contours, and FIG. 7 shows a pressure-flow rate characteristic of the regenerative motor 8 together with iso-efficiency contours. First, in the state of t3 in FIG. 2, the meter-out output W3 that the regenerative motor 8 receives is calculated from a pressure P3 and a flow rate Q3 as shown in FIG. 7. At this time, in the electrical power generator/electric motor 11, operating points thereof correspond to most efficient points on iso-drive output contours W3 of the electrical power generator 11 shown in FIG. 6. That is, by controlling the rotational speed from Nm3 to Nm3' employing a CVT 24, a more efficient electrical power generation becomes possible. In this way, W3 is calculated from the pressure P3 and the flow rate Q3 as shown in FIG. 7, Nm3' is found based on an electrical power generator optimal operational condition which has been set in advance in the controller for electrical power generator/electric motor 13, and the reduction ratio of the CVT 24 is determined by the ratio with respect to the rotational speed of the regenerative motor of this time.

What is claimed is:

1. A construction machine having an engine, a hydraulic pump driven by the engine, and an actuator driven by discharge oil from the hydraulic pump, wherein the construction machine is constructed in such a way that a rotation shaft of a regenerative motor, which rotates by return oil from the actuator, is connected to a rotation shaft of the hydraulic pump, and the hydraulic pump is driven by the engine and the regenerative motor when drive torque necessary in the hydraulic pump is larger than the output torque generated by operation of the regenerative motor, while the hydraulic pump is driven by the regenerative motor when the drive torque necessary in the hydraulic pump is smaller than the output torque generated by operation of the regenerative motor, and an electrical power generator connected to the rotation shaft of the regenerative motor is operated to generate electricity by excess torque, which has not been energy-regenerated in the hydraulic pump so that this generated electrical power is stored in an electricity storage device.

2. The construction machine according to claim 1, wherein the construction machine is constructed in such a way that the electrical power generator functions as an electric motor to perform motor operation so as to assist driving the hydraulic pump.

3. The construction machine according to claim 1 or 2, wherein the construction machine is constructed in such a way that a respective rotation shaft of the electrical power generator and the rotation shaft of the regenerative motor are provided separately from the rotation shaft of the hydraulic pump, and the respective electrical power generator, hydraulic pump, and regenerative motor can be operated together via interlock means.

4. A construction machine having an engine, a hydraulic pump driven by the engine, and an actuator driven by discharge oil from the hydraulic pump, wherein the construction machine is constructed in such a way that a regenerative motor, which rotates by return oil from the actuator, is connected to a rotation shaft of the hydraulic pump, and the hydraulic pump is driven by the engine and the regenerative motor when drive torque necessary in the hydraulic pump is larger than the output torque generated by operation of the regenerative motor, while the hydraulic pump is driven by the regenerative motor when the drive torque necessary in the hydraulic pump is smaller than the output torque generated by operation of the regenerative motor, and an electrical power generator connected to the rotation shaft of the regenerative motor is operated to generate electricity by excess torque, which has not been energy-regenerated in the hydraulic pump so that this generated electrical power is stored in an electricity storage device, wherein clutches for transmitting/disconnecting shaft torques to/from the rotation shaft of the hydraulic pump are provided on at least either one of the rotation shaft of the electrical power generator or the rotation shaft of the regenerative motor.

5. A construction machine having an engine, a hydraulic pump driven by the engine, and an actuator driven by discharge oil from the hydraulic pump, wherein the construction machine is constructed in such a way that a regenerative motor, which rotates by return oil from the actuator, is connected to a rotation shaft of the hydraulic pump, and the hydraulic pump is driven by the engine and the regenerative motor when drive torque necessary in the hydraulic pump is larger than the output torque generated by operation of the regenerative motor, while the hydraulic pump is driven by the regenerative motor when the drive torque necessary in the hydraulic pump is smaller than the output torque generated by operation of the regenerative motor, and an electrical power generator connected to the rotation shaft of the regenerative motor is operated to generate electricity by excess torque, which has not been energy-regenerated in the hydraulic pump so that this generated electrical power is stored in an electricity storage device, wherein a continuously variable transmission for changing the rotational speed of the electrical power generator with respect to the rotational speed of the regenerative motor is disposed between the electrical power generator and the regenerative motor.

* * * * *